United States Patent [19]

Wessel et al.

[11] 4,131,099

[45] Dec. 26, 1978

[54] IDLING AND WARM-UP FUEL CONTROL DEVICE

[75] Inventors: Wolf Wessel, Oberriexingen; Hermann Grieshaber, Stuttgart, both of Fed. Rep. of Germany

[73] Assignee: Robert Bosch GmbH, Stuttgart, Fed. Rep. of Germany

[21] Appl. No.: 738,980

[22] Filed: Nov. 4, 1976

[30] Foreign Application Priority Data

Jan. 24, 1976 [DE] Fed. Rep. of Germany ..... 2602698

[51] Int. Cl.[2] ..... F02B 33/00

[52] U.S. Cl. ..... 123/119 F; 123/139 E

[58] Field of Search ..... 123/139 E, 139 AW, 32 EA, 123/119 F, 139 G; 236/68 R, 101 D, 101 C, 101 B; 261/34 A; 137/484

[56] References Cited

U.S. PATENT DOCUMENTS

| | | | |
|---|---|---|---|
| 1,981,483 | 11/1934 | Weber | 261/34 A |
| 2,858,987 | 11/1958 | Ellis | 137/484 |
| 3,161,787 | 12/1964 | Van Jaan | 123/119 F |
| 3,300,137 | 1/1967 | Murphy | 236/101 C |
| 3,732,854 | 5/1973 | Martin | 123/139 E |
| 3,907,943 | 9/1975 | LaLeno et al. | 236/101 D |
| 3,967,781 | 7/1976 | Kunz | 236/101 B |

FOREIGN PATENT DOCUMENTS

| | | | |
|---|---|---|---|
| 1526703 | 10/1969 | Fed. Rep. of Germany | 123/32 EA |
| 2307136 | 11/1976 | France | 123/139 AW |

*Primary Examiner*—Ronald H. Lazarus
*Assistant Examiner*—R. A. Nelli
*Attorney, Agent, or Firm*—Edwin E. Greigg

[57] ABSTRACT

An improved throttle valve for use in the suction tube of a mixture compressing, externally ignited internal combustion engine in which the transversely extending shaft of the throttle valve is provided with an elongated aperture, the opening of which is arbitrarily variable by means of a movable valve component associated with a by-pass valve.

A reciprocal type valve as well as a rotary type valve are disclosed for controlling the aforesaid aperture with each said last-named valves being associated with electrical heater elements.

9 Claims, 4 Drawing Figures

IDLING AND WARM-UP FUEL CONTROL DEVICE

BACKGROUND OF THE INVENTION

The invention relates to a by-pass valve which is provided in the suction tube of an externally ignited internal combustion engine that is adapted to control the quantity of mixture fed to said engine during the warm running and idle running stages thereof.

In order to surmount the increased frictional moments present in a mixture compressing and externally ignited internal combustion engine which is not warm, there is required that a greater fuel-air quantity must be supplied as a function of the temperature and time during the idle operation of the engine than is necessary for an engine that has become warm. Heretofore it has been customary, for example, to open the throttle baffle plate or a by-pass as a function of temperature more than is required for an engine that has become operationally warm so that a greater mixture quantity can be aspirated by the internal combustion engine. However, the known devices have the disadvantage that both during the idle running, as well as during the warm running, the mixture is channelled near the wall of the suction tube, which results in a bad preconditioning of the mixture and a bad distribution of the mixture to the individual cylinders of the combustion engine.

OBJECT AND SUMMARY OF THE INVENTION

Accordingly, it is the primary object of this invention to develop a by-pass valve which will avoid such disadvantages.

This objective is achieved, according to the invention by arranging the transversely extending shaft of the throttle valve with an apertured area medially thereof, the cross-sectional area of which is arbitrarily or temperature dependently variable by means of a movable valve component of the by-pass valve.

An advantageous configuration of the invention consists in the fact that the movable valve component of the by-pass valve is constructed in the form of a piston slide located in an axial boring in the shaft of the throttle valve, and that the piston slide is temperature dependently displaceable by a bimetallic spring in such a way as to expose an idle state opening of the aperture at temperatures above about 30° C. as it butts against an idle state detent, as well as to expose a larger opening of the aperture at temperatures below about 30° C. Additionally, the bimetallic spring is associated with an electrical heater winding whose current circuit is closed by the closures of the ignition switch and the starter switch and is held closed even after the subsequent opening of the starter switch.

A further advantageous embodiment of the invention is one wherein the movable valve component of the by-pass valve is constructed in the form of a turn-slide that is located in an axial boring in the shaft of the throttle valve, which turn-slide is provided with an edge, arranged to control the size of the aperture of the throttle valve shaft, and further that the turn-slide is temperature dependently rotatable by means of a bimetallic spring constructed in the form of a spiral, and designed in such a way as to expose an idle state opening in the valve at temperatures above about 30° C. as it butts against an idle state detent, and to expose a still larger opening in the valve at temperatures below about 30° C.

According to an equally advantageous embodiment of the invention, the bimetallic spring is constructed in the form of a spiral and is arranged to be heated by an electrical heater winding immediately upon the initial starting of the combustion engine.

The invention will be better understood as well as other objects and advantages thereof become more apparent from the following detailed description of the invention taken in conjunction with the drawing.

DESCRIPTION OF THE PREFERRED EMBODIMENT

Figure 1:
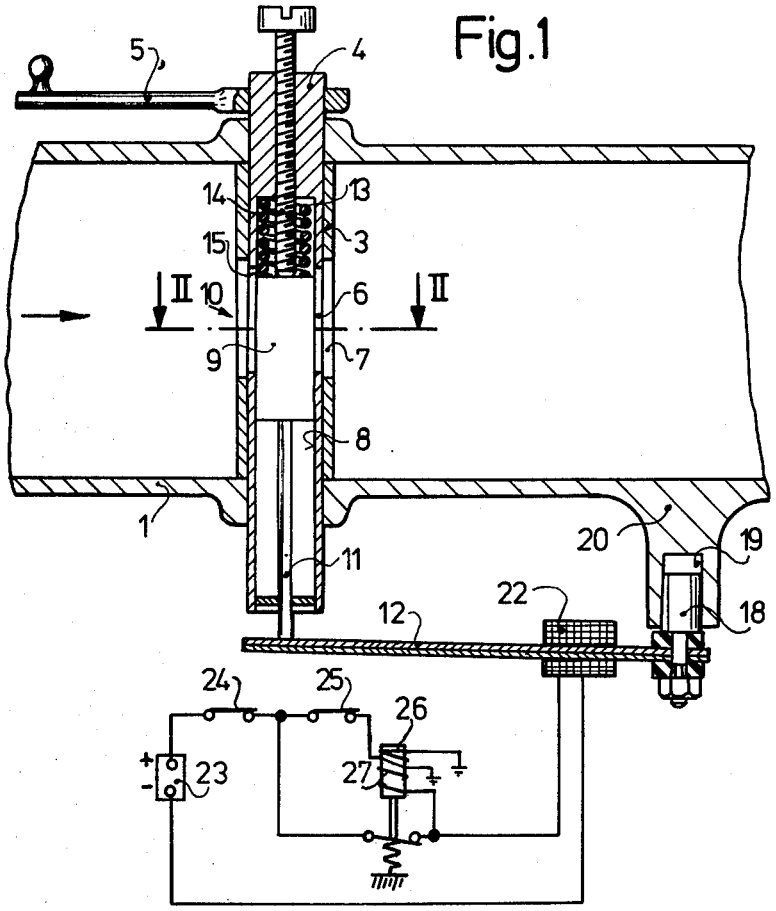
FIG. 1 illustrates a first exemplary embodiment, according to the invention, of the by-pass valve.

In the exemplary embodiment of the invention, the fuel-air mixture formed, for example, in a carburetor (not shown) or by the injection of fuel into the aspirated air through injection valves (not shown), flows in the direction of the arrow along a flow path within a suction tube section 1, past having a throttle valve 2, constructed in the form of a throttle baffle plate (FIG. 2), to one or several cylinders (not shown) of an internal combustion engine (not shown). The throttle valve 2 features a hub-shaped part 3, by means of which it is firmly attached to the throttle valve shaft 4 and arranged to extend transversely of the suction tube section 1. The actuation of the throttle valve shaft 4 and therewith of the throttle baffle plate 2 results from the actuation of the accelerator pedal (not shown) via a lever 5. The throttle valve shaft 4 contains means defining an aperture 6 which penetrates it radially and corresponding passages 7 for cooperation therewith are provided in the hub-shaped part 3 of the throttle baffle plate. The throttle valve shaft 4 contains an axial bore 8, within which is arranged to glide a piston slide 9, which forms the movable valve component of the by-pass valve 10 by increasing, more or less, the opening of the aperture 6. The piston slide 9 is acted upon on its one side via an actuation rod 11 by a bimetallic spring 12, through which the piston slide is displaced against a spring 13 at temperatures above about 30° C. in the direction of a diminution of the aperture 6, until it butts against an arbitrarily adjustable idle detent 14, at which point only an idle opening 15 of the aperture 6 remains open. The bimetallic spring 12 is secured at its fixed end to a bolt 18 that is pressed into a bore 19 of a protrusion 20 provided on a wall of the suction tube section 1. The bimetallic spring 12 carries an electrical heater winding 22, which is powered by the battery of the motor vehicle, and whose current circuit can be closed by means of the ignition switch 24 in conjunction with the starter switch 25 via a relay 26 having a latch winding 27.

Figure 2:
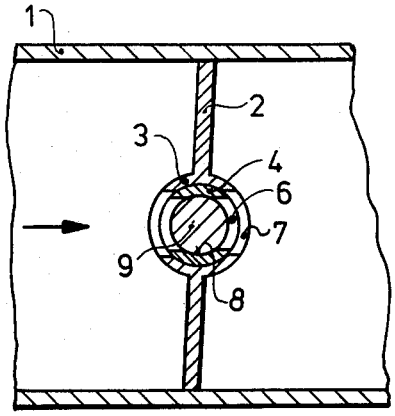
FIG. 2 is a section taken along the line II—II of FIG. 1.

The operation of the by-pass valve depicted in FIGS. 1 and 2 is as follows:

During the starting of the internal combustion engine at temperatures below about 30° C., the bimetallic spring 12 bends more or less in a direction away from the slidable piston 9, so that the slidable piston 9 is displaced in the direction of an enlargement of the opening of the aperture by the spring 13. If, the ignition switch 24 and subsequently the starter switch 25 are now closed at the initial starting of the internal combustion engine, then the relay 26 is actuated and the current circuit for the electrical heater winding 22 is completed.

The relay 26 is provided with a latch winding 27, so that even after the opening of the starter switch 25, i.e., after the completion of the starting process, the relay 26 remains actuated and the electrical heater winding 22 continues to receive current from the heater. As a consequence of the heating of the bimetallic spring by the electrical heater winding 22, the bimetallic spring 12 bends in a direction toward the piston slide 9, which piston slide 9 is moved by the bimetallic spring toward its closed direction until it butts against the arbitrarily adjustable idle detent 14, and then exposes only the idling opening 15 for the flow of the idling mixture through the aperture 6. By opening the ignition switch, i.e., by turning the internal combustion engine off, the current circuit of the electrical heater winding 22 is also interrupted.

The positioning of the by-pass valve 10 centrally of the throttle valve shaft 4 has the further advantage that the idle running mixture quantity and the warm running mixture quantity are controllable by a simple means, such that the placement of the by-pass valve 10 in the middle region of the cross section of the suction tube section 1 assures that the mixture is kept away from the walls as much as possible, thereby producing a good preconditioning of the mixture, and a good distribution of the mixture to the individual cylinders of the internal combustion engine. By appropriate selection of the electrical heater element, it is possible to limit the duration of admission of the supplementary mixture, during the warm running of the internal combustion engine.

Figure 3:
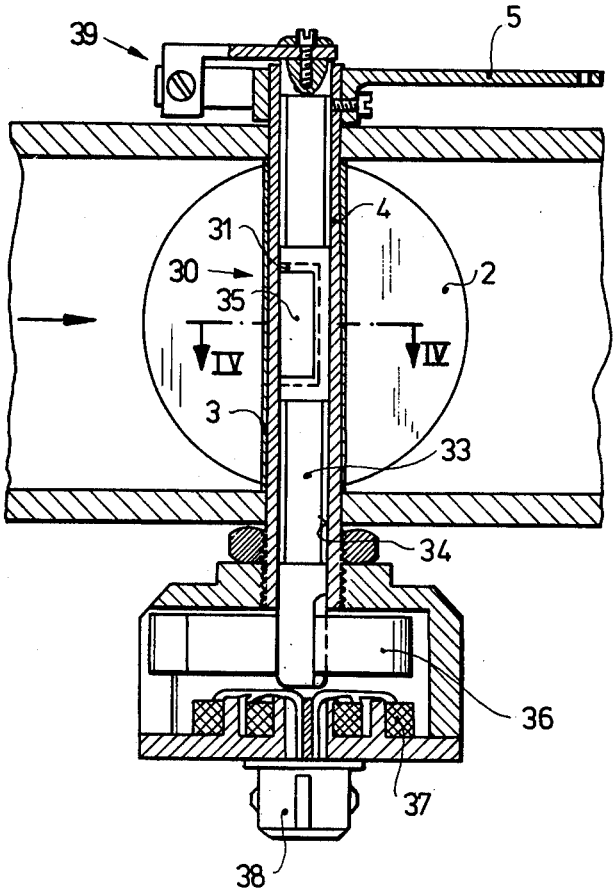
FIG. 3 illustrates a second exemplary embodiment, according to the invention, of the by-pass valve.
Figure 4:
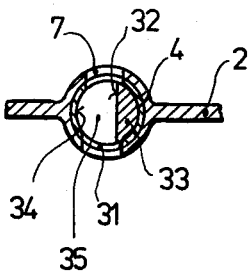
FIG. 4 is a section taken along the IV—IV of FIG. 3.

In the second exemplary embodiment of the invention according to FIGS. 3 and 4, identical components shown in FIGS. 1 and 2 are given the same reference numerals. In this embodiment, the by-pass valve 30 is positioned medially of the throttle shaft 4 as depicted by an aperture 31, which is opened more or less by the control edge 32 of the turn-slide 33 which constitutes the movable valve component. The turn-slide 33 is rotatable in an axial bore 34 of the throttle valve shaft 4, and includes a notch 35 having a control edge 32. Depending upon the given rotational position of the turn-slide 33, the control edge 32 provides a larger or smaller opening in the aperture 31 through the throttle valve shaft. A spiral shaped bimetallic spring 36 is attached to one end of the turn-slide 33, and is adapted to be heated by an electrical heater winding 37. The supply of current for the electrical heater winding 37 is carried out in the manner depicted in FIG. 1 via the connector 38 shown in FIG. 2. The rotary motion of the turn-slide 33, which results from the heating of the bimetallic spring 36, toward the closed direction of the by-pass valve 30, is limited by an idle detent 39, which is arbitrarily adjustable, so that after the completion of the warming up phase of the internal combustion engine, the opening of the aperture 31 is closed down to an idle running cross-sectional area. The operation of the exemplary embodiment according to FIGS. 3 and 4 corresponds to the operation already described for the first embodiment according to FIGS. 1 and 2.

What is claimed is:

1. A by-pass valve for controlling the mixture quantity delivered to a mixture compressing, externally ignited internal combustion engine during idle running and warm running of the engine, the engine having a suction tube connected thereto which defines a mixture quantity flow path, and a throttle valve mounted to the suction tube transversely of the mixture quantity flow path, the by-pass valve comprising:

a mounting shaft for the throttle valve, mounted to the suction tube for rotation relative to the suction tube, said mounting shaft having an aperture which extends transversely through the mounting shaft forming a part of the mixture quantity flow path, said aperture being located approximately at the medial region of the mounting shaft within the suction tube;

a movable valve component; and control means connected to the movable valve component for arbitrarily controlling the movement of the movable valve component relative to the mounting shaft, to thereby arbitrarily vary the portion of the mounting shaft aperture forming part of the mixture quantity flow path.

2. The by-pass valve as defined in claim 1, wherein the mounting shaft further has a longitudinal bore which intersects the mounting shaft aperture, wherein the movable valve component is constructed as a piston-like slide element positioned within the longitudinal bore, and wherein the control means includes means for reciprocating the piston-like slide element within the longitudinal bore.

3. The by-pass valve as defined in claim 2, wherein the control means includes a temperature dependent bimetallic spring element and an idle detent against which the movable valve component abuts during idle running of the engine.

4. The by-pass valve as defined in claim 3, wherein the control means further includes an electrical heater winding carried by the bimetallic spring and an electrical circuit including the electrical heater winding and the ignition switch and starter switch of the engine.

5. The by-pass valve as defined in claim 4, in which the electrical heater remains operative subsequent to opening of the starter switch.

6. The by-pass valve as defined in claim 1, wherein the mounting shaft further has a longitudinal bore which intersects the mounting shaft aperture, and wherein the movable valve component is constructed as a turn-slide element with a control edge for arbitrarily varying the portion of the mounting shaft aperture forming part of the mixture quantity flow path.

7. The by-pass valve as defined in claim 6, wherein the control means includes a temperature dependent spiral bimetallic spring element for rotating the movable valve component and an idle detent which limits the rotation of the movable valve component for idle running of the engine.

8. The by-pass valve as defined in claim 7, wherein the control means further includes an electrical heater winding for heating the bimetallic spiral spring.

9. The by-pass valve as defined in claim 8, in which the detent means is positioned exteriorly of said suction tube.

* * * * *